US007392766B2

(12) United States Patent
Jackson

(10) Patent No.: US 7,392,766 B2
(45) Date of Patent: Jul. 1, 2008

(54) TEMPERATURE AND PRESSURE RELIEF APPARATUS FOR WATER HEATER

(75) Inventor: Barry N. Jackson, Woodbury, MN (US)

(73) Assignee: Rheem Manufacturing Company, New York, NY (US)

( * ) Notice: Subject to any disclaimer, the term of this patent is extended or adjusted under 35 U.S.C. 154(b) by 56 days.

(21) Appl. No.: 11/562,033

(22) Filed: Nov. 21, 2006

(65) Prior Publication Data

US 2008/0115742 A1 May 22, 2008

(51) Int. Cl.
*F24H 9/20* (2006.01)
*F16K 17/40* (2006.01)

(52) U.S. Cl. ..... 122/14.3; 122/14.31; 122/14.1; 122/13.01; 137/72; 137/74

(58) Field of Classification Search ..... 122/13.01, 122/14.1, 14.3, 14.31, 504.1; 137/72, 74, 137/68.12; 220/203.8, 89.2, 89.4
See application file for complete search history.

(56) References Cited

U.S. PATENT DOCUMENTS 4,143,670 A 3/1979 Olson et al.
4,143,671 A 3/1979 Olson
4,744,383 A * 5/1988 Visnic et al. ..... 137/74
4,750,510 A * 6/1988 Short, III ..... 137/72
4,779,902 A 10/1988 Lee
4,827,962 A 5/1989 Picton
4,909,028 A 3/1990 Cetrelli et al.
4,949,862 A 8/1990 Barbarits et al.
5,006,689 A * 4/1991 Kurachi et al. ..... 122/13.01
5,279,321 A * 1/1994 Krimm ..... 220/89.2
5,575,312 A 11/1996 Schroeder
5,848,604 A 12/1998 Eihusen
5,923,819 A * 7/1999 Ross et al. ..... 392/441
6,698,386 B1 * 3/2004 Hoffman ..... 122/14.31
6,866,057 B1 * 3/2005 Buehrle, II ..... 137/74
6,898,373 B2 * 5/2005 Jackson ..... 392/451

* cited by examiner

*Primary Examiner*—Steven B. McAllister
*Assistant Examiner*—Andrew M Juettner
(74) *Attorney, Agent, or Firm*—Haynes and Boone, LLP

(57) ABSTRACT

A liquid heating appliance, representatively a water heater, is provided with protective apparatus for preventing rupture of its liquid storage tank portion caused by overheating of pressurized liquid therein. Illustratively, the protective apparatus includes a length of thermoplastic tubing, preferably polybutylene tubing, whose interior is exposed to the tank interior so as to be pressurized by heated liquid therein. In the event of a liquid overheating condition in the tank, the tubing is heat-softened in a manner reducing its burst pressure and causing it to burst, at a pressure substantially below the tank burst pressure, and thereby form a pressure relief outlet passage for the tank. A shield structure with at least one fluid outlet opening therein extends outwardly around the thermoplastic tubing to diffuse pressurized fluid escaping from the burst tubing.

32 Claims, 3 Drawing Sheets

TEMPERATURE AND PRESSURE RELIEF APPARATUS FOR WATER HEATER

BACKGROUND OF THE INVENTION

The present invention generally relates to liquid heating appliances, such as water heaters, and, in a preferred embodiment thereof, more particularly relates to protective apparatus used to prevent temperature and pressure-created bursting of tanks in which pressurized liquid is stored and heated.

There are many types of water heating appliances including gas, electric and oil fired water heaters, instantaneous water heaters, boilers, swimming pool heaters and the like, as well as various other types of liquid heating appliances. Such liquid heating appliances typically have a tank for holding liquid to be heated, and a heating system for heating the liquid to and maintaining it at a predetermined first heated temperature. With such liquid heating appliances the possibility exists of going into a heating "run-away" condition, if controls or safety devices fail, in which the temperature and pressure within the tank uncontrollably increase. If such temperature and pressure increases are not stopped, the tank can explode.

For this reason, liquid heating appliances of this general type are typically provided with a temperature and pressure relief valve which senses these increases and automatically opens to create a pressure relief passage, extending from the tank interior through the opened valve, that relieves the increasing pressure within the tank to prevent it from bursting. A temperature and pressure relief valve is normally based on opening a spring-loaded valve portion operated by a bimetal or equivalent rod activated by sensed temperature and/or pressure. The problem with these conventional types of temperature and pressure relief devices is that they are subject to failure due to scale build-up, corrosion, being plugged, leaking, being removed or not installed at all, etc. Failure of this conventional type of tank protective device for any reason leaves the tank susceptible to internal overpressurization and explosion. Accordingly, a need exists for liquid heating appliance overpressurization apparatus which eliminates or at least substantially reduces these problems associated with conventional temperature and pressure relief valves.

SUMMARY OF THE INVENTION

In carrying out principles of the present invention, in accordance with a preferred embodiment thereof, a liquid heating appliance, representatively a water heater, is provided with specially designed protective temperature and pressure relief apparatus. The liquid heating appliance comprises a tank, having a burst pressure, for holding a liquid to be heated, and a heating system operative to heat the liquid in the tank to a predetermined first heated temperature. The tank may be a metal tank, a plastic tank, a filament wound plastic tank, or a tank made from a variety of other suitable materials, and the heating system may be an electrical heating system, a fuel-fired heating system, or another suitable type of heating system.

The protective apparatus is operative to prevent rupture of the tank caused by heated liquid-created overpressurization of the tank, and may be utilized in place of or in addition to a conventional temperature and pressure relief valve operatively connected to the tank. In a preferred embodiment thereof the protective apparatus includes a barrier structure exposed to the interior of the tank and, during use of the liquid heating apparatus, forming a barrier to liquid outflow from the tank.

The barrier structure is representatively of a thermoplastic material, preferably polybutylene, and is heat-softenable, by pressurized tank liquid, at a second heated temperature greater than the first heated temperature, the heat-softened barrier structure being burstable, at a heat-reduced burst pressure less than the burst pressure of the tank, to thereby create a pressure outlet passage through the barrier structure that relieves internal tank liquid pressure before it reaches the burst pressure of the tank. In an illustrated water heater embodiment of the liquid heating appliance, the second heated temperature is approximately 300° F., and the burst pressure of the barrier structure at 300° F. is approximately 50 psi.

Representatively, the barrier structure is a length of thermoplastic tubing, preferably polybutylene tubing, and is provided with a mounting portion configured and operative to support the tubing in a manner such that its interior is exposed to the interior of the tank and forms a pressure rupturable barrier to liquid outflow therefrom. In one illustrative embodiment of the protective apparatus, the mounting portion is operative to install the tubing length in-line in a heated liquid supply pipe connected to the tank. In other illustrative embodiments of the protective apparatus, the mounting portion is operative to install the tubing length directly on the tank, either in a capped-off configuration or for connection to an inner end of the supply pipe. The tubing length, or a barrier structure of another configuration, may be provided with a shield structure positioned outwardly adjacent the barrier structure and having at least one fluid discharge opening therein which fluid exiting the pressure outlet passage through the barrier structure may outwardly pass. Such shield structure may comprise an outer tubular structure into which tubing length is telescoped, and the at least one fluid discharge opening may be defined by an open end of the outer tubular structure or by one or more perforations in its sidewall portion.

While the liquid heating appliance is representatively illustrated and described herein as being a water heater, those of skill in this particular art will readily appreciate that it could be a variety of other types of liquid heating appliances such as, for example, instantaneous water heaters, boilers, swimming pool heaters and the like. Additionally, while the protective apparatus barrier structure has been representatively illustrated and described herein as being of a tubular shape, it will be similarly be appreciated by those of skill in this particular art that it could have a variety of alternative configurations if desired without departing from principles of the present invention.

DETAILED DESCRIPTION

Figure 1:
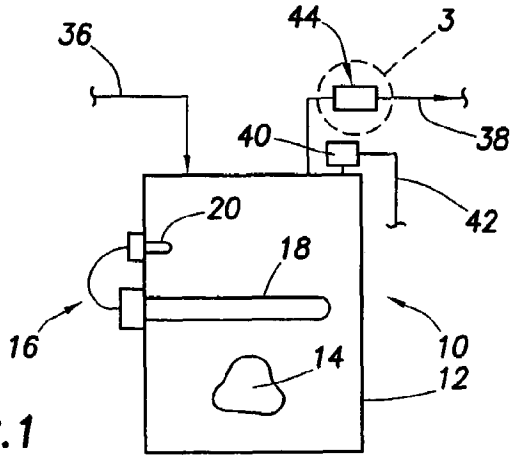
FIG. 1 is a schematic side elevational view of a representative electric water heater having installed thereon specially designed temperature and pressure protective apparatus embodying principles of the present invention.

Schematically depicted in FIG. 1 is a liquid heating appliance 10 embodying principles of the present invention. Appliance 10 is representatively a storage tank-type water heater, but could alternatively be a different type of liquid heating appliance, such as for example an instantaneous water heater, a boiler, a swimming pool heater or the like, without departing from principles of the present invention.

Water heater 10 has a tank 12 adapted to hold a quantity of pressurized water 14 to be heated, the tank 12 having a burst pressure. Tank 12 may be a metal tank, a plastic tank, a filament wound plastic tank, or a tank formed of another suitable impermeable material of sufficient strength for the intended liquid heating application. Water heater 10 is also provided with a heating system 16 operable to heat the tank-stored water 14 to and maintain the water at a predetermined first heated temperature. Illustratively, the heating system 16 is an electrical heating system including an immersible electric resistance type heating element 18 extending into the interior of the tank 12 and controlled by a water temperature-sensing thermostat 20.

Figure 2:
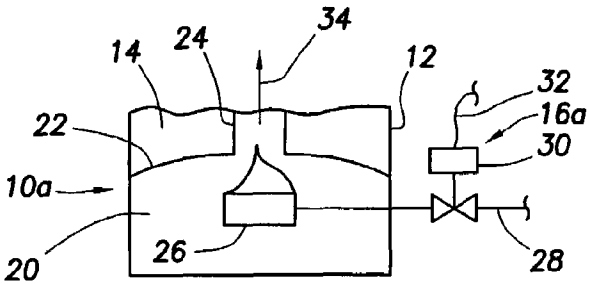
FIG. 2 is a schematic side elevational view of a lower portion of a representative fuel-fired water heater upon which the protective apparatus may also be installed.

An alternate embodiment 10*a* of the water heater 10, as schematically shown in FIG. 2, could alternatively be provided with a fuel-fired heating system 16*a*, of a suitable conventional construction, which representatively includes a combustion chamber 20 disposed beneath a lower end wall 22 of the tank 12 and having a flue pipe 24 extending upwardly through the tank interior and communicated at a lower end thereof with the interior of the combustion chamber 20. A fuel burner 26 is disposed within the combustion chamber 20 and is supplied with fuel via a fuel supply line 28 in which a fuel valve 30 is operatively interposed. Fuel valve 30, via control line 32, is controlled through the operation of a thermostat (such as the thermostat 20 shown in FIG. 1) that senses the temperature of the water 14 in the tank 12. During firing of the FIG. 2 water heater 10*a*, the burner 26 creates hot combustion gases 34 which flow upwardly through the flue 24 to heat the water in the tank 12.

Each of the water heaters 10,10*a* is provided with a cold water inlet line 36 for flowing pressurized cold water, from a suitable source thereof, into the tank interior, and a hot water outlet line 38 for providing an on-demand outflow of heated water to one or more plumbing fixtures (not shown) to which it is operatively connected. Illustratively, the inlet and outlet lines 36,38 are connected to the top end of the tank 12 in both of the water heater embodiments 10 and 10*a*. Also representatively connected to an upper end portion of the tank 12 of each of the water heater embodiments 10,10*a* is a conventional temperature and pressure (T&P) relief valve 40 operative to automatically open, and discharge tank water through an associated outlet pipe portion 42, if either the pressure or the temperature of the tank water exceeds a maximum predetermined set value thereof.

According to a key feature of the present invention, the water heater 10 (as well as the water heater 10*a*) is provided with specially designed protective apparatus 44 for preventing rupture of the tank 12 caused by excess heat-created overpressurization of the water 14 in the tank 12 created, for example, by a "run-away" condition of the heating system 16 or 16*a* causing the water temperature to climb far above its set point temperature. The protective apparatus 44 may be utilized in addition to or in place of the depicted temperature and pressure relief valve 40, and is of a unique no-moving-parts construction which will be subsequently described herein. Representatively, as shown in FIG. 1, the protective apparatus 44 is operably interposed in the hot water outlet line 38 adjacent the top end of the tank 12.

Figure 3:
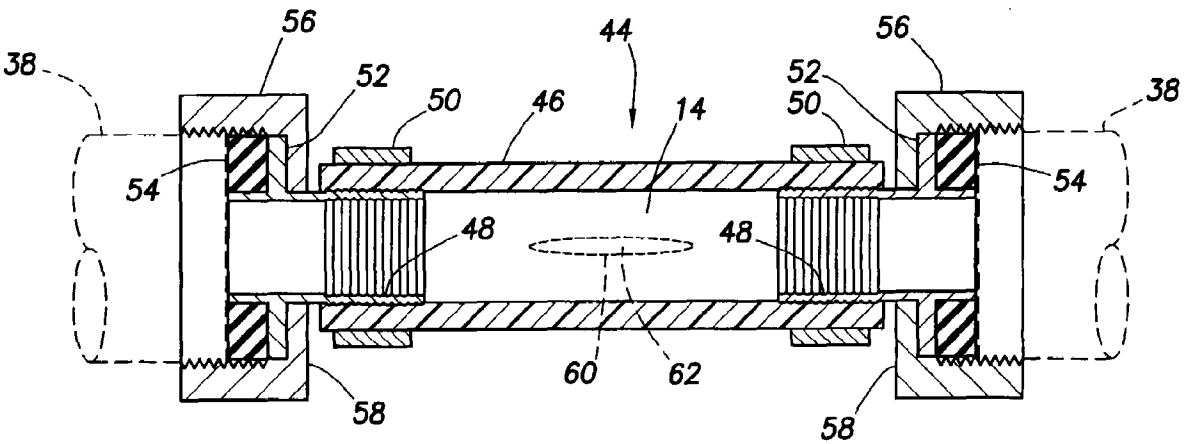
FIG. 3 is an enlargement of the dashed area "3" in FIG. 1 cross-sectionally illustrating the protective apparatus.

Turning now to FIG. 3, the protective apparatus 44 includes a first portion in the form of barrier structure 46 exposed to the interior of the tank 12 and, during operation if its associated water heater, forming a barrier to water outflow from the tank. The barrier structure 46 is heat-softenable, by pressurized tank water, at a second heated temperature greater than the aforementioned first heated set point temperature, the heat-softened barrier structure 46 being burstable, at a heat-reduced burst pressure less than the burst pressure of the tank 12, to thereby create a pressure outlet passage through the barrier structure that relieves internal tank water pressure before it reaches the burst pressure of the tank 12. While the barrier structure 46 could have a variety of alternate shapes if desired, it is preferably a length of thermoplastic tubing, most preferably of a polybutylene material.

The protective apparatus 44 also has a mounting portion configured and operative to support the thermoplastic barrier portion 46 relative to the tank 12 in a manner such the barrier portion 46 is exposed to the interior of the tank 12 and forms a pressure rupturable barrier to liquid outflow therefrom. As representatively shown in FIG. 3, this mounting portion includes a pair of tubular mounting bodies 48 having inner end portions telescopingly received in opposite ends of the tube 46 and fixedly secured therein by external annular clamping bands 50 extending externally around such opposite ends of the tube 46. Disposed on outer end portions of the mounting bodies 48 are annular external flanges 52 having outer side surfaces abutting inner side surface portions of annular elastomeric washers 54. Internally threaded nut members 56 have annular inner side portions 58 which rotatably receive portions of the mounting bodies 58 and are captively retained thereon between the flanges 52 and facing ends of the length 46 of thermoplastic tubing 46. Nuts 56 are threaded onto facing end portions of the hot water outlet line 38 to cause such facing line end portions to seal against the washers 54 therein and thereby seal the thermoplastic tube 46 in the line 38 and expose the interior of the tube to pressurized water 14 within the tank 12.

The length of polybutylene tubing 46 is selected such that, during normal operation of the water heater 10 or 10*a*, its burst strength is substantially above the operating pressure within the water heater tank 12. However, the tubing length 46 is representatively selected (as to, for example, wall thickness and thermoplastic characteristics) to be heat-softenable at approximately 300° to a heat-reduced burst pressure of approximately 50 psi—a burst pressure corresponding to the elevated 300° F. tank water temperature and well below the burst pressure of the tank 12.

Figure 4:
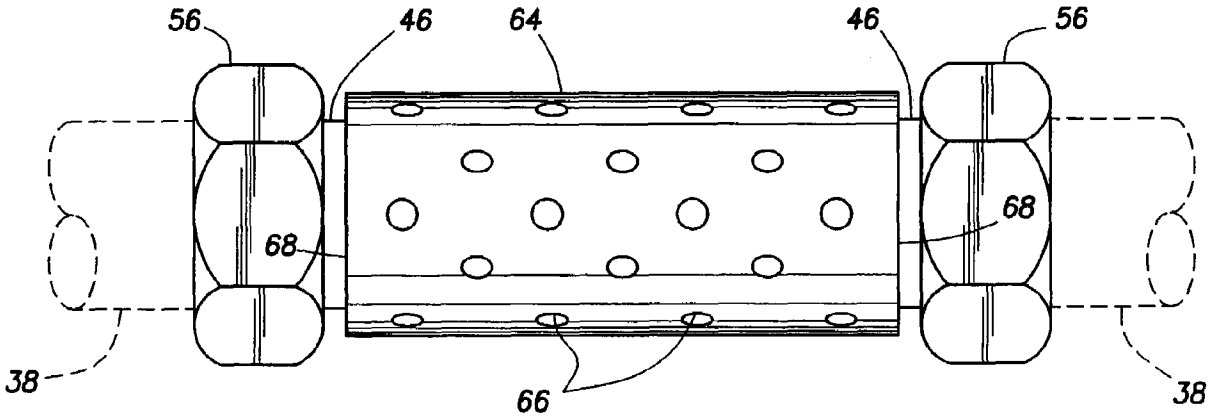
FIG. 4 is a side elevational view of the protective apparatus with an optional steam shield installed thereon.

Thus, in the event that a temperature "run-away" condition occurs, the tank water temperature reaches 300° F., and the temperature and pressure relief valve 40 fails for some reason, the length of thermoplastic tubing 46 splits (as at split area 60 in FIG. 3) to form through the side wall of the tubing length 46 a pressure relief passage 62 for the overpressurized tank water to escape (in the form of steam) outwardly through to prevent the tank water from reaching the burst pressure of the tank 12. To diffuse the steam escaping from the pressure relief passage 62 in the split tube 46, a tubular shield member 64 (see FIG. 4) may be telescoped over the thermoplastic barrier structure tube 46. Shield member 64 is representatively provided with a series of side wall perforations 66 through which the steam may outwardly escape, or the perforations 66 may be omitted in which case the steam simply escapes through the open opposite ends 68 of the tubular shield member 64. Of course, if the barrier structure 46 is of a different configuration than representatively illustrated herein the shield structure (if utilized) may also be of a different shape without departing from principles of the present invention.

Figure 5:
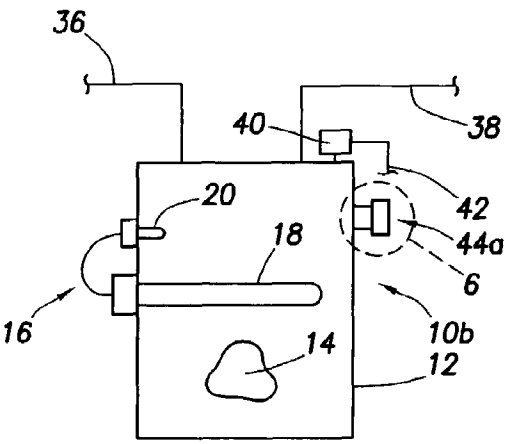
FIG. 5 is a schematic side elevational view of a representative electric water heater having installed thereon an alternate embodiment of the protective apparatus

Schematically depicted in FIG. 5 is a second alternate embodiment 10*b* of the previously described water heater 10. Water heater 10*b* is substantially identical to the electrical water heater 10 (but could, of course, alternatively be a fuel-fired water heater), with the exception that a modified protective apparatus 44*a* is utilized and connected directly to a side wall portion of the tank 12 as opposed to being interposed within the hot water outlet line 38.

Figure 6:
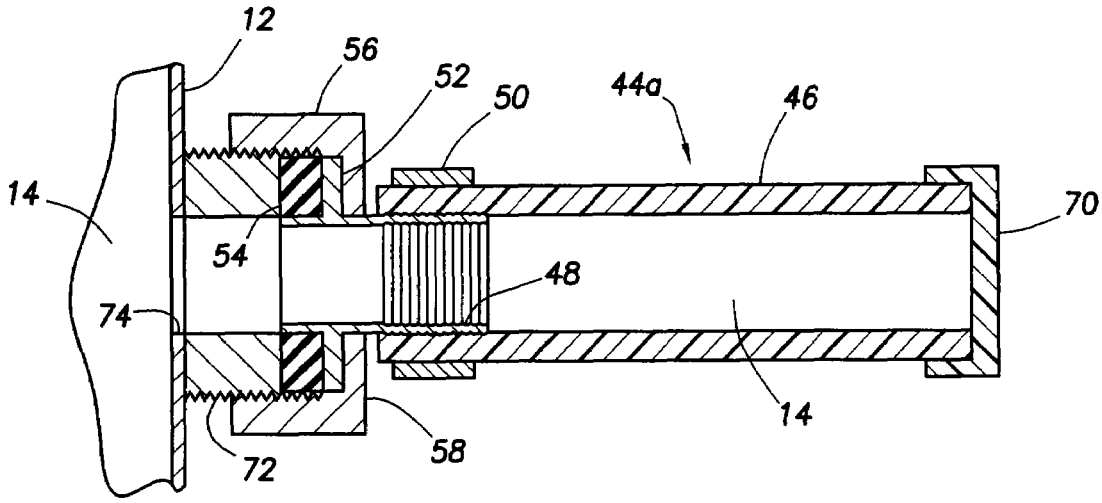
FIG. 6 is an enlargement of the dashed area "6" in FIG. 5 cross-sectionally illustrating the alternate protective apparatus embodiment.

Turning now to FIG. 6, it can be seen that the mounting portion of the protective apparatus 44*a* is, on the illustrated left end of the thermoplastic tube 46, substantially identical to the left side of the mounting apparatus shown in FIG. 3 and comprises the depicted nut 56 secured to the left end of the FIG. 6 tube 46 by means of the flanged mounting body 48 and its associated washer 54. The right end of the FIG. 6 tube 46 is simply closed off with a suitable cap structure 70. The single nut 56 in the protective apparatus 44*a* is threaded onto an externally threaded tubular connection member 72 secured to a vertical side wall portion of the tank 12 over an opening 74 therein. As can be seen, as in the previously described thermoplastic barrier structure 46 in the water heaters 10 and 10*a*, the interior of the protective barrier portion 46 of the protective apparatus 44*a* is exposed to tank water and its associated pressure. In the event of overheating of the tank water, the burst strength of the FIG. 6 tube 46 is heat-reduced to an extent that the tube 46 ruptures at a pressure well below the burst pressure of the tank 12. While an outer shield is not shown installed on the FIG. 6 protective apparatus 44*a*, it will be readily appreciated by those of skill in this particular art that its tube portion 46 could be appropriately provided with one if desired.

Figure 7:
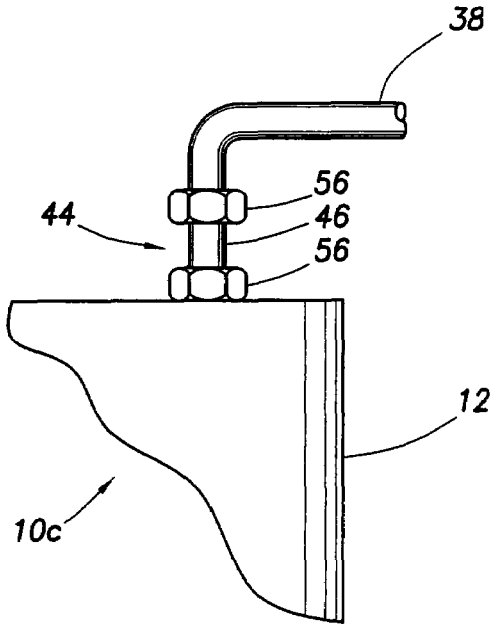
FIG. 7 is a schematic side elevational view of an upper portion of a representative water heater having the FIG. 3 protective apparatus installed directly to its tank portion.

FIG. 7 schematically depicts another method of connecting the FIG. 3 protective apparatus 44 to the tank 12 of an alternate water heater embodiment 10*c* which may be either an electric water heater or a fuel fired water heater. In this water heater embodiment the protective apparatus 44 is vertically secured directly to the top end of the tank 12, using the bottom nut member 56, with the interior of the thermoplastic barrier structure tube 46 communicating with the interior of the tank 12. Using the upper end nut 56, the inner end of the hot water outlet line 38 is connected to the top end of the protective apparatus 44.

In addition to protecting their associated liquid heating tank from overpressurization as previously described herein, each of representatively depicted protective structures 44,44*a* also provides another desirable advantage. Specifically, the protective apparatus, in any of its depicted forms and mounting locations can be simply replaced if it is ever activated and the tank put back into service (after the necessary repairs to the controls, etc. that caused the run-away heating condition that activated the protective apparatus). On the other hand, a tank whose conventional temperature and pressure relief apparatus failed during a heating run-away condition would burst, requiring that the entire water heater structure be scrapped.

The foregoing detailed description is to be clearly understood as being given by way of illustration and example only, the spirit and scope of the present invention being limited solely by the appended claims.

What is claimed is:

1. A liquid heating appliance comprising:

a tank, having a burst pressure, for holding a liquid to be heated;

a heating system operative to heat the liquid in the tank to a predetermined first heated temperature; and protective apparatus for preventing rupture of said tank caused by heated liquid-created overpressurization thereof, said protective apparatus including;

a barrier structure comprising a hollow thermoplastic body portion forming a barrier to liquid outflow from said tank and having an interior exposed to the interior of said tank, said hollow thermoplastic body portion being heat-softenable, by pressurized tank liquid, at a second heated temperature greater than said first heated temperature, the heat-softened hollow thermoplastic body portion being burstable, at a heat-reduced burst pressure less than said burst pressure of said tank, to thereby create a pressure outlet passage through said hollow thermoplastic body portion that relieves internal tank liquid pressure before it reaches said burst pressure of said tank.

2. The liquid heating appliance of claim 1 wherein:

said liquid heating appliance is a water heater.

3. The liquid heating appliance of claim 1 wherein:

said tank is a metal tank.

4. The liquid heating appliance of claim 1 wherein:

said tank is a plastic tank.

5. The liquid heating appliance of claim 1 wherein:

said tank is a filament wound plastic tank.

6. The liquid heating appliance of claim 1 wherein:

said heating system is a fuel-fired heating system.

7. The liquid heating appliance of claim 1 wherein:

said heating system is an electrical heating system.

8. The liquid heating appliance of claim 1 wherein:

the thermoplastic material of said hollow thermoplastic body portion is polybutylene.

9. The liquid heating appliance of claim 1 wherein:

said barrier structure is connected directly to said tank.

10. The liquid heating appliance of claim 1 wherein:

said liquid heating appliance further comprises a heated liquid supply pipe connected to said tank, and said barrier structure is operably connected to said heated liquid supply pipe and permits tank liquid outflow therethrough during normal operation of said liquid heating appliance.

11. The liquid heating appliance of claim 1 further comprising:

a shield structure positioned outwardly adjacent said barrier structure and having at least one fluid discharge opening therein through which fluid exiting said pressure outlet passage may outwardly pass.

12. A liquid heating appliance comprising:

a tank, having a burst pressure, for holding a liquid to be heated;

a heating system operative to heat the liquid in the tank to a predetermined first heated temperature; and protective apparatus for preventing rupture of said tank caused by heated liquid-created overpressurization thereof, said protective apparatus including:

a barrier structure exposed to the interior of said tank and, during use of said liquid heating appliance, forming a barrier to liquid outflow from said tank, said barrier structure being heat-softenable, by pressurized tank liquid, at a second heated temperature greater than said first heated temperature, the heat-softened barrier structure being burstable, at a heat-reduced burst pressure less than said burst pressure of said tank, to thereby create a pressure outlet passage through said barrier structure that relieves internal tank liquid pressure before it reaches said burst pressure of said tank, said barrier structure comprising a length of thermoplastic tubing.

13. The liquid heating appliance of claim 12 wherein:

said length of thermoplastic tubing is a length of polybutylene tubing.

14. A liquid heating appliance comprising:

a tank, having a burst pressure, for holding a liquid to be heated;

a heating system operative to heat the liquid in the tank to a predetermined first heated temperature; and protective apparatus for preventing rupture of said tank caused by heated liquid-created overpressurization thereof, said protective apparatus including:

a barrier structure comprising a hollow body portion exposed to the interior of said tank and, during use of said liquid heating appliance, forming a barrier to liquid outflow from said tank, said barrier structure being heat-softenable, by pressurized tank liquid, at a second heated temperature greater than said first heated temperature, the heat-softened barrier structure being burstable, at a heat-reduced burst pressure less than said burst pressure of said tank, to thereby create a pressure outlet passage through said barrier structure that relieves internal tank liquid pressure before it reaches said burst pressure of said tank, said second heated temperature being approximately 300° F., and the burst pressure of said barrier structure at 300° F. being approximately 50 psig.

15. A water heater comprising:

a tank for holding water, said tank having a burst pressure;

a heating system operative to heat the water in the tank to a predetermined first heated temperature; and protective apparatus for preventing rupture of said tank caused by excess heat-created overpressurization of the water in the tank, said protective apparatus including:

a hollow thermoplastic body disposed externally of said tank and having a pressurizable interior exposed to the interior of said tank, said hollow thermoplastic body being heat-softenable, at a second heated temperature greater than said first heated temperature, the heat-softened hollow thermoplastic body being burstable at an internal pressure less than said burst pressure of said tank to thereby relieve internal tank water pressure before it reaches said burst pressure of said tank.

16. The water heater of claim 15 wherein:

said second heated temperature is about 300° F., and said internal pressure less than said burst pressure of said tank is about 50 psi.

17. The water heater of claim 15 wherein:

said hollow thermoplastic body is a length of thermoplastic tubing.

18. The water heater of claim 17 wherein:

said thermoplastic tubing is of a polybutylene material.

19. The water heater of claim 15 wherein:

said hollow thermoplastic body is connected directly to said tank.

20. The water heater of claim 15 wherein:

said tank has a hot water supply pipe connected thereto, and said hollow thermoplastic body is connected to said hot water supply pipe with the interior of said hollow thermoplastic body communicating with the interior of said hot water supply pipe.

21. The water heater of claim 15 further comprising:

a steam shield extending outwardly around said hollow thermoplastic body and having at least one fluid discharge opening therein.

22. The water heater of claim 21 wherein:

said hollow thermoplastic body and said steam shield have tubular configurations, with said steam shield outwardly circumscribing said hollow thermoplastic body.

23. The water heater of claim 21 wherein:

said steam shield has perforations therein.

24. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a barrier portion comprising a hollow thermoplastic body heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said barrier portion in a manner such that the interior of said hollow thermoplastic body is exposed to the interior of the tank and forms a pressure rupturable barrier to liquid outflow therefrom.

25. The protective apparatus of claim 24 wherein:

said mounting portion is configured and operative to support said thermoplastic barrier portion directly on said tank.

26. The protective apparatus of claim 24 further comprising:

a shield structure extending around said thermoplastic barrier portion and having at least one fluid discharge opening therein.

27. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a thermoplastic barrier portion heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said thermoplastic barrier portion in a manner such that it is exposed to the interior of the tank and forms a pressure rupturable barrier to liquid outflow therefrom, said thermoplastic barrier portion being formed from a polybutylene material.

28. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a thermoplastic barrier portion heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said thermoplastic barrier portion in a manner such that it is exposed to the interior of the tank and forms a pressure rupturable barrier to liquid outflow therefrom, said thermoplastic barrier portion having a tubular configuration.

29. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a thermoplastic barrier portion heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said thermoplastic barrier portion in a manner such that it is exposed to the interior of the tank and forms a pressure rupturable barrier to liquid outflow therefrom, said thermoplastic barrier portion being heat-softenable at approximately 300° F., and said heat-reduced burst pressure being approximately 50 psig.

30. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a thermoplastic barrier portion heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said thermoplastic barrier portion in a manner such that it is exposed to the interior of the tank and forms a pressure rupturable barrier to liquid outflow therefrom, said thermoplastic barrier portion having a hollow configuration, said tank having a heated liquid supply pipe connected thereto, and said mounting portion being configured and operative to connect said thermoplastic barrier portion to said heated liquid supply pipe in a manner communicating the interiors of said supply pipe and said barrier portion.

31. For use with a liquid heating appliance having a tank for holding liquid, the tank having a burst pressure, and a heating system operative to heat the liquid in the tank to a predetermined first heated temperature, protective apparatus for preventing rupture of said tank caused by heated liquid-created overpressurization thereof, said protective apparatus comprising:

a thermoplastic barrier portion heat-softenable at a second heated temperature greater than said predetermined first heated temperature, the heat-softened thermoplastic barrier portion being pressure burstable, to form a pressure relief passage therethrough, at a heat-reduced burst pressure less than said burst pressure of said tank; and a mounting portion configured and operative to support said thermoplastic barrier portion in a manner such that it is exposed to the interior of the tank and forms a pressure rupturable barrier to liquid outflow therefrom, said shield structure and said thermoplastic barrier portion having tubular configurations, with said shield structure telescopingly receiving said thermoplastic barrier portion.

32. The protective apparatus of claim 31 wherein:

said shield structure has a perforated side wall.

* * * * *